US007493893B2

(12) United States Patent
Funabashi et al.

(10) Patent No.: US 7,493,893 B2
(45) Date of Patent: Feb. 24, 2009

(54) FUEL SUPPLY SYSTEM FOR DIESEL ENGINE

(75) Inventors: Mamoru Funabashi, Saitama (JP); Yuta Ebinuma, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/727,208

(22) Filed: Mar. 23, 2007

(65) Prior Publication Data

US 2007/0283929 A1 Dec. 13, 2007

(30) Foreign Application Priority Data

Apr. 18, 2006 (JP) ..... 2006-114969

(51) Int. Cl.
*F02M 37/04* (2006.01)
*F02D 41/38* (2006.01)

(52) U.S. Cl. ..... 123/497; 123/464; 123/457

(58) Field of Classification Search ..... 123/510–511, 123/514, 457–464, 381, 497
See application file for complete search history.

(56) References Cited

U.S. PATENT DOCUMENTS 3,927,830 A * 12/1975 Briski ..... 62/225
4,020,814 A * 5/1977 Hewitt et al. ..... 123/359
4,175,527 A * 11/1979 Sanada et al. ..... 123/514
4,187,813 A * 2/1980 Stumpp ..... 123/510
4,190,198 A * 2/1980 Casuga et al. ..... 236/34.5
4,320,734 A * 3/1982 Balachandran ..... 123/510
4,411,239 A * 10/1983 Kelch ..... 123/557
4,411,240 A * 10/1983 Kravetz ..... 123/557
4,434,777 A * 3/1984 Straubel ..... 123/445
4,454,851 A * 6/1984 Bourbonnaud et al. ..... 123/557
4,459,964 A * 7/1984 Straubel et al. ..... 123/458
4,478,197 A * 10/1984 Yasuhara et al. ..... 123/514
4,488,680 A * 12/1984 Itoh ..... 236/93 A
4,617,116 A * 10/1986 Seiler ..... 210/137
4,625,701 A * 12/1986 Bartlett et al. ..... 123/514
4,850,327 A * 7/1989 Fayard ..... 123/557
4,893,603 A * 1/1990 Siebels ..... 123/514
5,024,200 A * 6/1991 Free et al. ..... 123/501
5,085,198 A * 2/1992 Bartlett et al. ..... 123/510

(Continued)

FOREIGN PATENT DOCUMENTS

JP 2003-176761 6/2003

*Primary Examiner*—Thomas N Moulis
(74) *Attorney, Agent, or Firm*—Arent Fox LLP

(57) ABSTRACT

A fuel supply system is incorporated into a diesel engine including a low-pressure fuel pump 2, a high-pressure fuel pump 3, a common rail 4, fuel injection valves 5 and a fuel return line 14. The fuel supply system reduces the discharge rate of the low-pressure fuel pump 2 supplying the fuel to the high-pressure fuel pump 3 when the diesel engine is in an idling state and the temperature of the fuel is below a lower fuel temperature threshold and when the diesel engine is in an idling state and the temperature of the fuel is above an upper fuel temperature threshold. The flow rate of the feed fuel discharged from the low-pressure fuel pump is reduced when an idling state or a specific state where the fuel is at a specific temperature. Thus the fuel line system of the fuel supply system can be built in a lightweight arrangement and the piping of the fuel line system can be simplified.

10 Claims, 2 Drawing Sheets

U.S. PATENT DOCUMENTS 5,263,456 A * 11/1993 Owen-Evans ..... 123/495
5,269,276 A * 12/1993 Brown ..... 123/514
5,626,114 A * 5/1997 Kushida et al. ..... 123/198 D
5,685,278 A * 11/1997 Bradford et al. ..... 123/514
5,918,578 A * 7/1999 Oda ..... 123/456
6,024,064 A * 2/2000 Kato et al. ..... 123/179.17
6,289,879 B1 * 9/2001 Clausen et al. ..... 123/516
6,527,947 B1 * 3/2003 Channing et al. ..... 210/136
6,615,806 B2 * 9/2003 Schueler ..... 123/514
6,708,671 B1 * 3/2004 Joos et al. ..... 123/464
6,742,503 B2 * 6/2004 Feucht ..... 123/446
6,752,130 B2 * 6/2004 Schueler et al. ..... 123/514
6,769,414 B2 * 8/2004 Rembold et al. ..... 123/514
6,805,105 B2 * 10/2004 Kato et al. ..... 123/514
6,823,846 B2 * 11/2004 Mattes ..... 123/456
6,889,656 B1 * 5/2005 Rembold et al. ..... 123/446
6,964,267 B2 * 11/2005 Jin ..... 123/514
7,082,928 B2 * 8/2006 Fritsch et al. ..... 123/478
7,270,112 B2 * 9/2007 Kinose ..... 123/431
7,318,417 B2 * 1/2008 Lang et al. ..... 123/467
2002/0083923 A1 * 7/2002 Suzuki et al. ..... 123/464
2002/0092505 A1 * 7/2002 Rembold et al. ..... 123/464
2002/0124834 A1 * 9/2002 Rembold et al. ..... 123/514
2002/0134360 A1 * 9/2002 Hankins et al. ..... 123/514
2003/0209232 A1 * 11/2003 Hou ..... 123/459
2005/0092304 A1 * 5/2005 Jin ..... 123/514
2007/0209638 A1 * 9/2007 Becker ..... 123/445

* cited by examiner

FUEL SUPPLY SYSTEM FOR DIESEL ENGINE

BACKGROUND OF THE INVENTION

1. Technical Field

The present invention relates to a fuel supply system for a diesel engine provided with a pressure fuel accumulator and, more specifically, to a fuel supply system capable of controlling the discharge of a low-pressure fuel pump for supplying fuel to a high-pressure fuel pump.

2. Description of the Related Art

A diesel engine provided with a pressure fuel accumulator for accumulating fuel discharged from a high-pressure fuel pump under pressure, such as disclosed in JP-A 2003-176761, is well known. Generally, in a diesel engine provided with a pressure fuel accumulator, injection quantity of the fuel to be injected in each injection cycle of a fuel injection valve is controlled through the control of injection valve opening duration. Therefore a low pressure fuel pump for supplying the fuel to a high-pressure fuel pump is operated at a fixed discharge rate to adjust the pressure of the fuel in the pressure fuel accumulator to a predetermined pressure. There has been a trend to increase the discharge pressure of the high-pressure fuel pump to improve flammability, and the quantity of the fuel supplied by the low-pressure fuel pump for cooling and lubricating the high-pressure pump has been increased accordingly.

If the low-pressure fuel pump supplies the fuel at a fixed fuel supply rate to the high-pressure fuel pump, the fuel is supplied excessively to the high-pressure fuel pump during idling operation in which the injection quantity is small and, consequently, the quantity of the fuel returned from the high-pressure fuel pump increases. If a return fuel pipe connected to the high-pressure fuel pump is used also as a return fuel pipe connected to the fuel injection valves and the pressure fuel accumulator, a large quantity of the fuel that has returned from the high-pressure fuel pump, in some cases, obstructs the smooth flow of the fuel returned from the fuel injection valves and the pressure fuel accumulator and causes troubles including the deterioration of the accuracy of controlling the injection quantity of the fuel. The weight of a fuel line system increases and the piping of the fuel line system is complicated when a fuel return pipe of a large diameter is used and fuel return pipes are connected individually to the fuel injection valves and the pressure fuel accumulator to return the fuel smoothly.

While the engine is in warm-up operation, in which injection quantity is comparatively small and the quantity of the returned fuel is comparatively large, and the temperature of the fuel is low, wax contained in light oil deposits. Consequently, it is possible that the fuel filter is clogged up with the wax and the fuel cannot be supplied at a predetermined rate when a large quantity of the fuel flows through the fuel filter. If a large quantity of the fuel heated at a high temperature is returned into the fuel tank after the high-load operation of the engine, component parts of the fuel tank including rubber seals are exposed to heat, which affects the life of those component parts adversely. The fuel return pipe of an automotive engine mounted on a vehicle is cooled by running wind while the vehicle is running. Therefore, heating of the return fuel at high temperatures can be suppressed. However, the return fuel is not cooled by running wind while the vehicle is stopping and the engine is in an idling state, the effect of the high-temperature return fuel on the component parts of the fuel tank is significant.

SUMMARY OF THE INVENTION

The present invention has been made in view of such problems and it is therefore a main object of the present invention to reduce the weight of the fuel line system of a fuel supply system and to simplify the piping of the fuel line system by reducing the flow rate of feed fuel discharged from the low-pressure fuel pump while the engine is in an idling state or the fuel is heated at a specific temperature. Another object of the present invention is to prevent the clogging of a fuel filter by a simple arrangement and to reduce the thermal influence of high-temperature return fuel on component parts which are exposed to the high-temperature return fuel.

A fuel supply system according to the present invention, for a diesel engine includes a low-pressure fuel pump for sucking fuel from a fuel tank and discharging the fuel as low-pressure feed fuel, a high-pressure fuel pump for sucking the low-pressure feed fuel and discharging high-pressure fuel, a fuel injection valve for injecting the high-pressure fuel, and a fuel return line for carrying return fuel discharged from the high-pressure fuel pump, the fuel supply system comprising: a status detecting means for detecting at least one of an idling state or a fuel temperature; and a flow rate control means for controlling a flow rate of the feed fuel; wherein the flow rate control means is operative to reduce the flow rate of the feed fuel when the status detecting means detects an idling state or a specific fuel temperature indicating a specific state.

According to the present invention, a discharge rate at which the low-pressure fuel pump discharges the feed fuel is reduced when the engine is in an idling state or a specific fuel temperature is detected. Therefore, a large quantity of the fuel does not need to be returned into the fuel tank while the engine is in an idling state or when the fuel is at the specific fuel temperature. Accordingly, it is unnecessary to use a fuel return pipe of a large diameter, the fuel line system of the fuel supply system is of lightweight and the piping is simple.

The fuel supply system in an embodiment of the present invention comprises a fuel filter for removing foreign matters from the feed fuel; wherein the status detecting means is a temperature measuring means for measuring the fuel temperature, and the specific fuel temperature is below a lower fuel temperature threshold.

The fuel supply system according to the embodiment reduces the flow rate of the feed fuel while the temperature of the fuel is low. Therefore, the clogging of the fuel filter with wax contained in the fuel and likely to deposit when the temperature of the fuel is low can be suppressed and hence the fuel can be supplied to the high-pressure fuel pump and to the fuel injection valves at desired flow rates, respectively. Thus injection quantity can be accurately controlled.

In the present invention, the status detecting means may be a temperature measuring means for measuring the fuel temperature, and the specific fuel temperature is above an upper fuel temperature threshold.

The flow rate of the feed fuel is reduced when the fuel temperature is high and hence the quantity of the high-temperature return fuel returned to the fuel tank and such decreases. Consequently, the thermal influence of the high-temperature fuel on the component parts of the fuel tank and such can be reduced and the life of those component parts can be extended.

Preferably, the status detecting means includes an idling state detecting means and a temperature measuring means for measuring the fuel temperature, and the control means is operative to reduce the flow rate of the feed fuel when an idling state is detected by the idling state detecting means and a temperature measured by the temperature measuring means is equal to the specific fuel temperature.

Thus the clogging of the fuel filter with the wax that occurs when the fuel is supplied at a high flow rate to the high-pressure fuel pump while the engine is in an idling state in which the feed fuel does not need to be fed at a high feed rate because the injection quantity is small can be avoided. Moreover, since the discharge of the fuel from the high-pressure fuel pump is reduced while the engine is in an idling state subsequent to warm-up operation in which the temperature of the fuel is high and the thermal influence of a large quantity of the high-temperature return fuel on the component parts of the fuel tank and such is significant, the accuracy of injection quantity control can be improved and the durability of the component parts of the fuel tank and such can be improved.

The fuel supply system according to the present invention may comprise a fuel quantity measuring means for measuring a quantity of the fuel contained in the fuel tank; wherein the control means is operative to reduce the discharge rate when the temperature of the fuel exceeds the upper fuel temperature threshold and the fuel quantity measuring means detects a special condition where the quantity of the fuel contained in the fuel tank is not greater than a predetermined quantity.

Thus the thermal influence on the component parts of the fuel tank can be suppressed.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
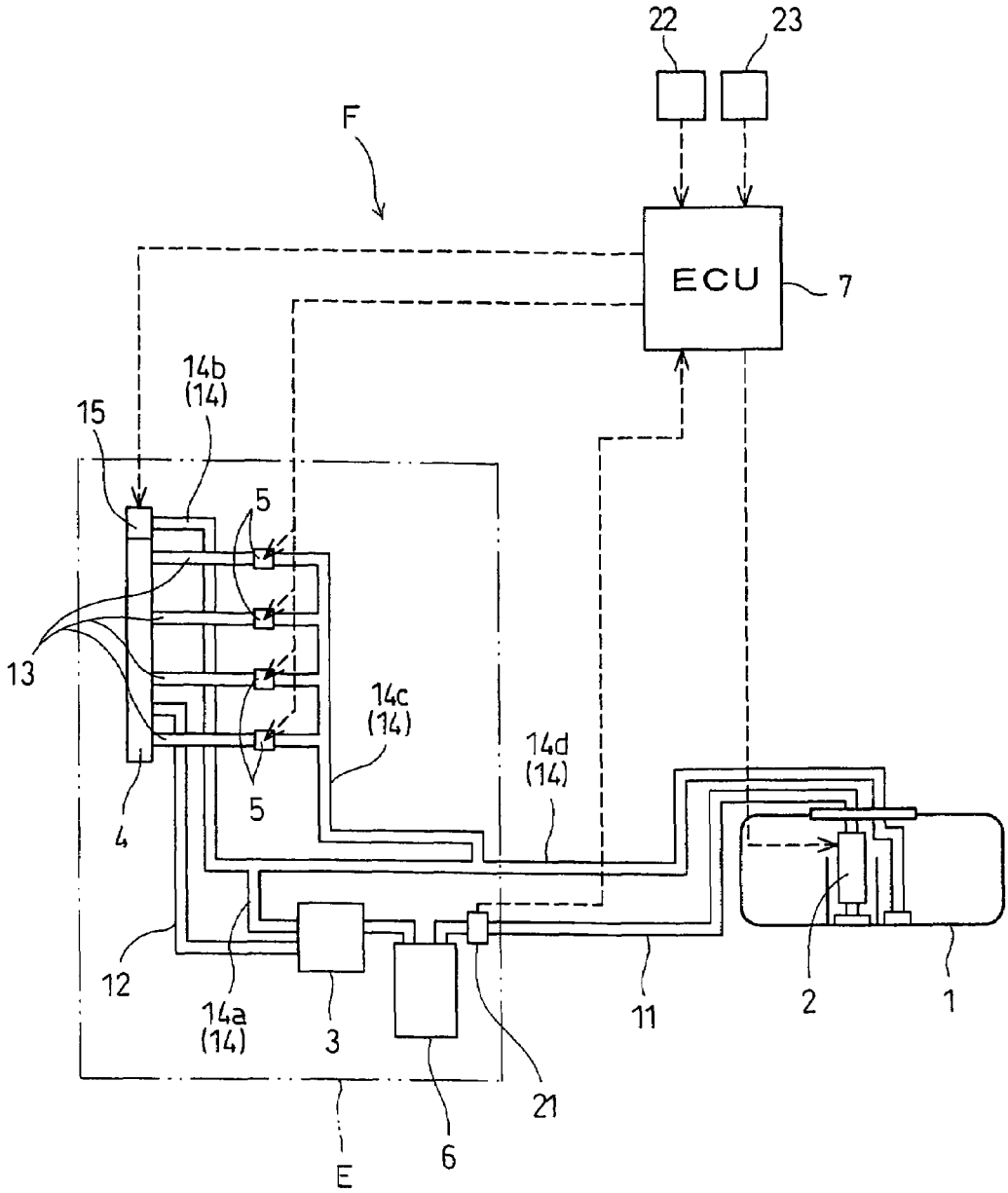
FIG. 1 is a diagrammatic view of a fuel supply system in a preferred embodiment of the present invention.

Referring to FIG. 1, a fuel supply system F in a preferred embodiment of the present invention is intended to be used for a diesel engine E. The diesel engine E is an automotive in-line 4-cylinder 4-stroke engine mounted on a vehicle. The diesel engine E has an engine body including a cylinder block provided with cylinders in which pistons reciprocates to drive a crankshaft for rotation, and a cylinder head. Fuel injection valves 5 are attached to the cylinder head. The fuel injection valves 5 inject fuel directly into combustion chambers each formed between the cylinder head and the piston.

The fuel supply system F supplies the fuel, light oil, to be injected into the combustion chambers, to the fuel injection valves 5. The fuel supply system F includes a fuel tank 1 made of a synthetic resin and containing the fuel, a low-pressure pump 2 which pumps up the fuel from the fuel tank 1 and forces the fuel out as feed fuel, a high-pressure fuel pump 3 which sucks the feed fuel discharged from the low-pressure fuel pump and discharge high-pressure fuel, a common rail 4, namely, a pressure fuel accumulator, the four fuel injection valves 5 connected to the common rail 4 and capable of injecting the fuel received from the common rail 4 into the cylinders, a fuel filter 6 for filtering out foreign matters from the feed fuel discharged from the low-pressure fuel pump 2, detectors, which will be described later, an electronic control unit (hereinafter, abbreviated to "ECU") 7, namely, control means, which receives signals provided by the detectors and controls the low-pressure fuel pump 2 and the fuel injection valves 5, and a fuel line system including conduits and pipe fittings.

The fuel line system includes a low-pressure fuel pipe 11 for carrying the feed fuel from the low-pressure fuel pump 2 to the high-pressure fuel pump 3, a pressure fuel pipe 12 for carrying the pressure fuel from the high-pressure fuel pump 3 to the common rail 4, delivery pipes 13 for delivering the pressure fuel from the common rail 4 to the fuel injection valves 5, and a return fuel pipe 14 for carrying return fuel from the high-pressure fuel pump 3, the common rail 4 and the fuel injection valves 5 to the fuel tank 1. The return pipe 14 includes a first branch pipe 14*a* connected to the high-pressure fuel pump 3, a second branch pipe 14*b* connected through a pressure regulating valve 15 to the common rail 4, a third branch pipe 14*c* connected to the fuel injection valves 5, and a junction pipe 14*d* connected to the branch pipes 14*a*, 14*b* and 14*c* and having an end part inserted into the fuel tank 1.

The low-pressure fuel pump 2, which is an electric pump, is placed in the fuel tank 1. The ECU 7 controls power supplied to the low-pressure fuel pump 2 to control the discharge rate of the low-pressure fuel pump 2. The high-pressure fuel pump 3 is a positive-displacement reciprocating pump rotatively driven by the engine E. The excessive feed fuel and the fuel used for cooling and lubricating the high-pressure fuel pump 3 are returned through the first branch pipe 14*a* and the junction pipe 14*d* into the fuel tank 1.

High pressure oil in the common rail 4 is adjusted to a predetermined pressure by the pressure regulating valve 15 controlled by the ECU 7, and excessive pressure fuel discharged from the pressure regulating valve 15 is returned through a return fuel pipe including the second branch pipe 14*b* and the junction pipe 14*d* into the fuel tank 1. Excessive pressure fuel discharged from the fuel injection valves 5 is returned through a return fuel pipe including the third branch pipe 14*c* and the junction pipe 14*d* into the fuel tank 1.

The fuel filter 6 is placed in a low-pressure fuel pipe 11 connecting the low-pressure fuel pump 2 and the high-pressure fuel pump 3.

The ECU 7 controls the fuel injection valves 5, which are electromagnetic valves, according to the operating condition of the engine E to inject a predetermined quantity of the fuel, namely, a predetermined fuel injection quantity, into the combustion chambers at predetermined times of injection.

The detectors includes a temperature measuring device 21, namely, temperature measuring means, placed near the oil filter 6 to measure the temperature of the fuel, an idling state detector 22, namely, an idling state detecting means, for detecting an idling state of the engine E, and an engine speed measuring device 23, namely, a rotating speed measuring means, for measuring engine speed. The idling state detector 22 detects an idling state on the basis of engine speed and engine load. Engine load is determined on the basis of a fuel injection quantity injected by each of the fuel injection valves 5.

The temperature measuring device 21 and the idling state detector 22 constitute a status detecting system, namely, a status detecting means, for detecting fuel temperature and the idling state.

Figure 2:
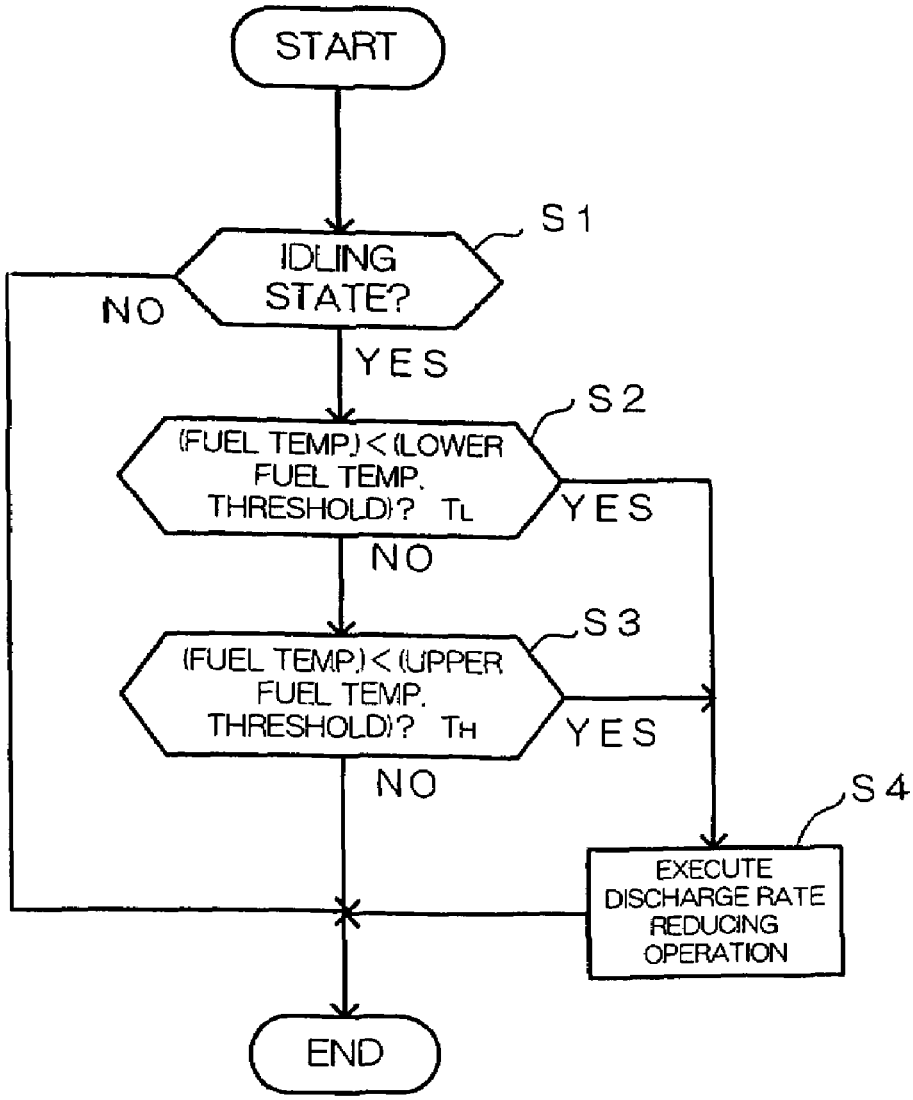
FIG. 2 is a flow chart of a discharge rate reducing procedure for reducing the discharge rate of a low-pressure fuel pump included in the fuel supply system shown in FIG. 1.

A discharge rate reducing procedure shown in FIG. 2 for reducing the discharge rate of the low-pressure fuel pump 2 included in the fuel supply system F to reduce the flow rate of the feed fuel will be described.

The discharge rate reducing procedure is repeated periodically. Referring to FIGS. 1 and 2, a decision is made in step S1 on the basis of a signal provided by the idling state detector 22 as to if the engine E is in an idling state, namely, a specific state. If the engine E is in an operating state under load and is not in an idling state, the discharge rate reducing procedure is ended. If the engine E is in an idling state, the procedure goes to step S2 and a query is made in step S2 to see if a fuel temperature measured by the temperature measuring device 21 is below a lower fuel temperature threshold $T_L$ of, for example, −3° C.

If the response to the query in step S2 is affirmative, that is, if the engine E is warming up and the fuel temperature is low as compared with a fuel temperature after warm-up and is below the lower fuel temperature threshold $T_L$, step S4 is executed. In step S4, a discharge rate reducing operation for reducing the discharge rate of the low-pressure fuel pump 2 is carried out. A fuel temperature below the lower fuel temperature threshold $T_L$ is a specific fuel temperature measured by the temperature measuring device 21 and indicating a specific condition. The discharge rate of the low-pressure fuel pump 2 is controlled to reduce the flow rate of the feed fuel. The lower fuel temperature threshold $T_L$ is determined properly taking the amount of deposited wax which increases with the drop of the fuel temperature into consideration so as to prevent the fuel filter 6 from being clogged with the deposited wax.

The discharge rate reducing operation to be executed in step S4 reduces the discharge rate of the low-pressure fuel pump 2 (or the flow rate of the feed fuel) to a low discharge rate (or a low flow rate). The low discharge rate (or the low flow rate) is, for example, 60% of a normal discharge rate (or a normal flow rate). The discharge rate reducing operation is continued while the engine E is in an idling state and the fuel temperature is below the lower fuel temperature threshold $T_L$.

After the engine E has warmed up and the fuel temperature rises beyond the lower fuel temperature threshold $T_L$, the fuel filter 6 will not be clogged with the wax. In this state, the response to the query made in step S2 is negative and step S3 is executed. In step S3 a query is made to see if a fuel temperature measured by the temperature measuring device 21 is above an upper fuel temperature threshold $T_H$ of, for example, 80° C. If the response to the query made in step S3 is negative, i.e., if the measured fuel temperature is not higher than the upper fuel temperature threshold $T_H$, the discharge rate reducing operation for reducing the discharge rate of the low-pressure fuel pump 2 is not executed and the low-pressure fuel pump 2 discharges the feed fuel at a normal discharge rate.

Even if the response to the query made in step S3 is negative and the measured fuel temperature is not higher than the upper fuel temperature threshold $T_H$, a discharge rate reducing operation to adjust the discharge rate to a value higher than the discharge rate determined by the discharge rate reducing operation executed in step S4 and lower than the normal discharge rate may be executed when the engine E is in an idling state in which the injection quantity of the fuel injected through the fuel injection valves 5 is small.

If the response to the query made in step S3 is affirmative and the fuel temperature is higher than the upper fuel temperature threshold $T_H$, which occurs when the vehicle is stopped after the engine E has operated under a high load and the engine E is idling, a discharge rate reducing operation, namely, a high-temperature discharge rate reducing operation, for reducing the discharge rate of the low-pressure fuel pump 2 is executed in step S4. The fuel temperature above the upper fuel temperature threshold $T_H$, similarly to the fuel temperature below the lower fuel temperature threshold $T_L$, is a specific fuel temperature indicating a specific state detected by the temperature measuring device 21. The upper fuel temperature threshold $T_H$ is determined such that the heat of the return fuel may not exert a detrimental effect on the component parts susceptible to heat of the fuel tank 1, such as rubber seals. The discharge rate reducing operation is continued while the engine E is idling and the specific condition in which the fuel temperature is above the upper fuel temperature threshold $T_H$ is established.

The operation and effect of the embodiment will be described.

The fuel supply system F of the diesel engine E reduces the flow rate of the feed fuel discharged from the low-pressure fuel pump 2 by reducing the discharge rate of the low-pressure fuel pump 2 to a value below the normal flow rate when the idling state detector 22 detects an idling state and the fuel temperature measured by the fuel temperature measuring device 21 is below the lower fuel temperature threshold $T_L$. Thus a large quantity of the return fuel does not need to be returned to the fuel tank 1 while the engine E is idling, in which the injection quantity is small and the feed fuel does not need to be supplied at a high flow rate. Accordingly, the return fuel pipe 14 does not need to be a large-diameter pipe, the fuel line system of the fuel supply system F can be of light weight and the piping can be made simple. Since the return fuel can smoothly return to the fuel tank 1 even though the return fuel pipe 14*d*, the junction pipe 14*d*, the accuracy of injection quantity control can be improved. Since the flow rate of the feed fuel is reduced when the temperature of the fuel is low, the clogging of the fuel filter 6 with the wax contained in the fuel, which is likely to occur when the feed fuel is supplied at a high flow rate to the high-pressure fuel pump 3, is suppressed and the fuel can be supplied at a necessary flow rate to the high-pressure pump 3 and the pressure fuel accumulator and, consequently, accurate injection quantity control can be achieved.

The discharge rate of the low-pressure fuel pump 2 placed in the fuel tank 1 is controlled to prevent the fuel filter 6 from being clogged with the wax. Therefore, the fuel supply line does not need to be provided with any additional part for preventing the clogging of the fuel filter 6, which simplifies the piping.

When an idling state is detected by the idling state detector and the fuel temperature measured by the temperature measuring device 21 is a specific fuel temperature above the upper fuel temperature threshold $T_H$, the discharge rate of the low-pressure fuel pump 2 is reduced below the normal discharge rate for the normal state. Thus the flow rate of the feed fuel is reduced by reducing the discharge rate of the low-pressure fuel pump 2 to reduce the quantity of the return fuel returned to the fuel tank 1 when the fuel temperature is above the upper fuel temperature threshold $T_H$ in such a state where the vehicle is stopped and the engine E is idling. Thus the thermal influence of the high-temperature fuel on the component parts of the fuel tank 1 is lessened and the life of those component parts can be extended.

When the low-pressure fuel pump 2 is thus placed in the fuel tank 1, the fuel contained in the fuel tank 1 is heated by heat generated by the low-pressure fuel pump 2. Since the discharge rate of the low-pressure fuel pump 2 is reduced, heat generated by the low-pressure fuel pump 2 decreases accordingly, and the rise of the temperature of the fuel contained in the fuel tank 1 can be suppressed.

Modifications of the fuel supply system F will be described.

The thermal influence of the return fuel on the component parts of the fuel tank is more significant when the quantity of the fuel contained in the fuel tank 1 is smaller because the temperature of the return fuel does not drop significantly when the return fuel is mixed with a small quantity of the fuel contained in the fuel tank 1. Therefore, the high-temperature discharge rate reducing operation may be carried out according to the quantity of the fuel contained in the fuel tank 1. More concretely, when the fuel temperature is above the upper fuel temperature threshold $T_H$ and the quantity of the fuel contained in the fuel tank 1 measured by a fuel level sensor 17 for measuring the quantity of the fuel in the fuel tank 1, namely, a status detecting means, indicates a specific state where the quantity of the fuel contained in the fuel tank 1 is not greater than a predetermined quantity, such as a quantity equal to 50% of the capacity of the fuel tank 1, the ECU 7 executes the discharge rate reducing operation to reduce thermal influence on the component parts of the fuel tank 1.

The status detecting system may include only either one of the temperature measuring device 21 and the idling state detector 22. The discharge rate of the low-pressure fuel pump 2 may be controlled only on the basis of fuel temperature while the engine E is operating in a loaded operating mode other than an idling mode or may be continuously controlled regardless of fuel temperature while the engine E is operating in an idling mode.

The temperature measuring device 21 does not need to be a sensor that measures the temperature of the fuel directly; the temperature measuring device 1 may determine the temperature of the fuel indirectly on the basis of the temperature of the cooling water or the lubricating oil, namely, engine temperature.

The flow rate of the feed fuel to be controlled may be the flow rate of the feed fuel returned from a part of the low-pressure fuel pipe 11 on the upstream side of the high-pressure fuel pump 3 or the fuel filter 6 to the fuel tank 1.

The return fuel may be carried by the return fuel pipe 14 to a low-pressure part other than the fuel tank 1, such as a low-pressure part in the fuel line system.

The discharge rate reducing operation started to reduce the discharge rate of the low-pressure fuel pump 2 may be continued until the temperature of the fuel rises to a temperature in a normal fuel temperature range, for example, between 5° C. and 60° C. or the idling state is terminated.

The temperature measuring device 21 may be incorporated into the case of the fuel filter 6 to measure the temperature of the fuel in the vicinity of the fuel filter 6 more accurately.

Although the internal combustion engine has been supposed to be an automotive internal combustion engine mounted on a vehicle in the foregoing description, the present invention is applicable to an internal combustion engine other than the foregoing automotive internal combustion engine, such as an engine included in a marine propulsion device, such as an outboard engine provided with a vertical crankshaft.

What is claimed is:

1. A fuel supply system for a diesel engine including a low-pressure fuel pump for sucking fuel from a fuel tank and discharging the fuel as low-pressure feed fuel, a high-pressure fuel pump for sucking the low-pressure feed fuel and discharging high-pressure fuel, a fuel injection valve for injecting the high-pressure fuel, and a fuel return line for carrying return fuel discharged from the high-pressure fuel pump, said fuel supply system comprising:

status detecting means for detecting an idling state and a fuel temperature; and flow rate control means for controlling a flow rate of the feed fuel;

wherein the flow rate control means is operative to reduce the flow rate of the feed fuel when the status detecting means detects an idling state and a fuel temperature below a threshold temperature.

2. The fuel supply system according to claim 1, further comprising a fuel filter for removing foreign matters from the feed fuel.

3. The fuel supply system according to claim 1, wherein the status detecting means comprises a temperature measuring means for measuring the fuel temperature.

4. The fuel supply system according to claim 2, wherein the control means is operative to reduce the flow rate of the feed fuel when an idling state is detected by the idling state detecting means and a temperature measured by the temperature measuring means is equal to a specific fuel temperature.

5. The fuel supply system according to claim 1, further comprising a fuel quantity measuring means for measuring a quantity of the fuel contained in the fuel tank;

wherein the control means is operative to reduce the discharge rate when the temperature of the fuel exceeds an upper fuel temperature threshold and the fuel quantity measuring means detects a special condition where the quantity of the fuel contained in the fuel tank is not greater than a predetermined quantity.

6. A fuel supply system for a diesel engine including a low-pressure fuel pump for sucking fuel from a fuel tank and discharging the fuel as low-pressure feed fuel, a high-pressure fuel pump for sucking the low-pressure feed fuel and discharging high-pressure fuel, a fuel injection valve for injecting the high-pressure fuel, and a fuel return line for carrying return fuel discharged from the high-pressure fuel pump, wherein said fuel supply system comprises:

status detecting means for detecting at least a fuel temperature;

flow rate control means for controlling a flow rate of the feed fuel;

said flow rate control means being operative to reduce the flow rate of the feed fuel when the status detecting means detects a specific fuel temperature indicating a specific state; and a fuel filter for removing foreign matters from the feed fuel;

wherein the status detecting means includes a temperature measuring means for measuring the fuel temperature, and said specific fuel temperature is below a predetermined fuel temperature threshold at which the fuel filter could be clogged by deposition of wax contained in the fuel.

7. The fuel supply system according to claim 6, wherein said status detecting means further includes an idling state detecting means, and the control means is operative to reduce the flow rate of the feed fuel when an idling state is detected by the idling state detecting means and a temperature measured by the temperature measuring means is equal to the specific fuel temperature.

8. A fuel supply system for a diesel engine including a low-pressure fuel pump for sucking fuel from a fuel tank and discharging the fuel as low-pressure feed fuel, a high-pressure fuel pump for sucking the low-pressure feed fuel and discharging high-pressure fuel, a fuel injection valve for injecting the high-pressure fuel, and a fuel return line for carrying return fuel discharged from the high-pressure fuel pump, wherein said fuel supply system comprises:

status detecting means for detecting at least a fuel temperature;

flow rate control means for controlling a flow rate of the feed fuel; and said flow rate control means being operative to reduce the flow rate of the feed fuel when the status detecting means detects a specific fuel temperature indicating a specific state;

said fuel tank including component parts susceptible to heat the fuel in the fuel tank;

wherein the status detecting means includes a temperature measuring means for measuring the fuel temperature, and said specific fuel temperature is above a predetermined fuel temperature threshold at which the component parts of the fuel tank could be thermally influenced by the fuel returning to the fuel tank.

9. The fuel supply system according to claim 8, further comprising a fuel quantity measuring means for measuring a quantity of the fuel contained in the fuel tank, wherein the control means is operative to reduce the flow rate of the feed fuel when the temperature of the fuel is above the predetermined fuel temperature threshold and the quantity of the fuel contained in the fuel tank is not greater than a predetermined quantity.

10. The fuel supply system according to claim 8, wherein said status detecting means further includes an idling state detecting means, and the control means is operative to reduce the flow rate of the feed fuel when an idling state is detected by the idling state detecting means and a temperature measured by the temperature measuring means is equal to the specific fuel temperature.

* * * * *